United States Patent [19]

Westermeyer

[11] Patent Number: 4,609,895

[45] Date of Patent: Sep. 2, 1986

[54] AUTOMATIC SWITCH WITH INTEGRAL CONTACT INDICATOR

[75] Inventor: Joseph Westermeyer, Nuremberg, Fed. Rep. of Germany

[73] Assignee: Sursum Elektrizitatsgesellschaft Leyhausen GmbH & Co., Nuremberg, Fed. Rep. of Germany

[21] Appl. No.: 664,011

[22] Filed: Oct. 23, 1984

[30] Foreign Application Priority Data

Oct. 29, 1983 [DE] Fed. Rep. of Germany ..... 3339398

[51] Int. Cl.[4] ..... H01H 73/12; H01H 71/04

[52] U.S. Cl. ..... 335/17; 337/79

[58] Field of Search ..... 335/17; 337/79; 200/308

[56] References Cited

U.S. PATENT DOCUMENTS

| | | | |
|---|---|---|---|
| 2,343,323 | 3/1944 | Pierce | 200/147 R |
| 3,246,098 | 4/1966 | Hall . | |
| 4,001,743 | 1/1977 | Arnhold | 335/201 |
| 4,206,430 | 6/1980 | Rusch et al. | 335/20 |
| 4,223,288 | 9/1980 | Stiner | 335/20 |
| 4,301,342 | 11/1981 | Castonguay et al. | 335/17 |

FOREIGN PATENT DOCUMENTS

| | | |
|---|---|---|
| 2813431 | 10/1979 | Fed. Rep. of Germany . |
| 2063566 | 11/1979 | United Kingdom . |

*Primary Examiner*—Harold Broome

*Attorney, Agent, or Firm*—Holman & Stern

[57] ABSTRACT

An automatic switch wherein a pivotal switch lever is trippable by means of either a solenoid, a thermal element or a hand lever. The grip member of said hand lever extends out through an opening in the forward side of the switch housing which is configured to communicate the actual state of the switch contacts to an external observer, regardless of the position of the hand lever. This is achieved through the use of a window mounted in the forward section of the switch housing near the hand lever opening and in the region of the forward end of the pivotal switch lever, which bears a pivotal detent lever and an indicator strip. This strip has one section which is disposed directly behind the window when the switch lever is in a certain position, but when the switch lever is in its other position that section is displaced from the window, effectively making it invisible to an outside observer. Since the switch lever also contains the movable contact element of the switch (circuit-breaker), the position of said lever corresponds to the instantaneous position of the movable switch contact.

4 Claims, 3 Drawing Figures

AUTOMATIC SWITCH WITH INTEGRAL CONTACT INDICATOR

FIELD OF THE INVENTION

The invention relates to an automatic switch with both an open- and a closed-contact position.

In a known automatic switch of this type (Ger. AS No. 19 04 731), the connection between the hand lever and switch lever is not rigid whereby the switch lever must necessarily follow the hand lever from the closed position into the open position. Should the two contact elements stick together in undesired fashion, then the switch contacts in this known switch would not open despite movement of the hand lever to the "open" position (where the lever is forced under the action of a wire spring). The hand lever would then outwardly appear to be in a position which would not reveal the true state of the switch contacts and thus the condition of the external circuit. Therefore, the hand lever in this known switch is not a sufficiently reliable indication of the switch circuit state.

Accordingly, it is an object of the invention to devise an automatic switch of the type above-described wherein the actual state of the switch contacts is accurately ascertainable by an external observer regardless of the position of the hand lever.

SUMMARY OF THE INVENTION

This object is achieved by this claimed invention by an automatic switch characterized in that a window is provided in the forward side of the housing near the hand lever opening and in the region of the end of the switch lever bearing a pivotal detent lever. An indicator strip is mounted on the end of said switch lever which strip has a section which is disposed directly behind the window when the switch lever is in a certain position, but when the switch lever is in its other position this section gets displaced above or below the window (i.e., out of the main line of sight of an observer).

A movable contact element is mounted on one end of a pivotal switch lever which bears a three-armed arresting lever, one arm of which arresting lever extends around and to the far side of a detent lever, to engage releasably said detent lever so as to break the switch contacts. This detent lever is pivotally mounted on the opposite end of said switch lever and is connected to a pivotally mounted hand lever via a link piece. The grip member of said hand lever passes through an opening in the forward side of the switch housing.

Since the switch's movable contact element is identical with the switch lever, the position of the lever corresponds to the instantaneous position of the movable switch contact. The state of the switch is thus signaled according to whether the indicator strip is disposed directly behind the window or not. This signaling by the internal strip is achieved at low cost, since the end of the switch lever bearing the detent lever is already disposed near the forward side of the housing and near the hand lever. This invented structure is simple, and due to the length of the switching lever arm the excursion of the strip is relatively long as well.

It is particularly advantageous if the said indicator strip is secured to a block which, in turn, is mounted to the pivot pin of the detent lever. This further simplifies the structure.

It is particularly advantageous if the indicator strip is longer than the window in the direction of movement of the forward end of the switch lever, and further if said strip has two differently colored sections, one of which corresponds to the open position of the switch contacts and the other to the closed position.

A preferred embodiment of the invention is illustrated in the drawings.

DETAILED DESCRIPTION OF THE DRAWINGS

Figure 1:
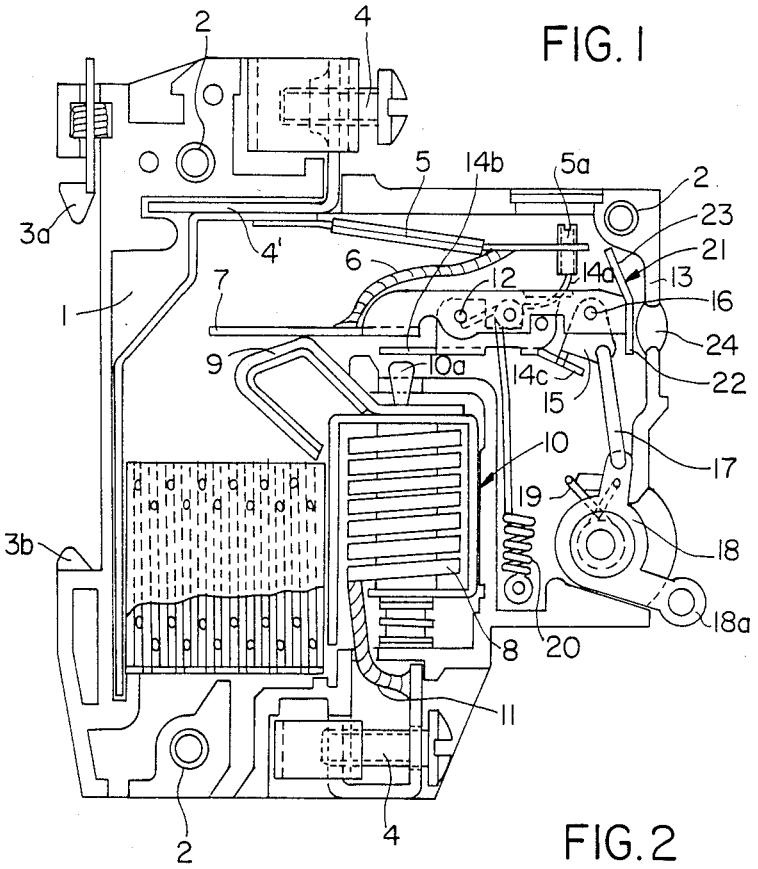
FIG. 1 is a side view of an automatic switch with contacts in the closed position.

With reference to FIG. 1, the automatic switch illustrated is comprised of a narrow housing, or box, 1 and a cover (not shown) which is placed on said housing. There are three eyelets 2 located on the sidewalls of the box 1 which eyelets correspond to matching boreholes which may be used to register said cover and through which rivets may be inserted to hold the housing fastened together. Mutually facing hooks 3*a* and 3*b* are disposed on the rear side of the housing, one of which hooks 3*a* is spring-loaded. These hooks serve as a means for mounting the housing 1 on rails or other equivalent superstructure.

A screw clamp 4*a* is disposed on an upper transverse face, and another screw clamp 4*b* is disposed on a lower transverse face. External primary-circuit conductors for supplying and conducting away current can be connected to said screw clamps (terminals). The upper screw clamp 4*a* is mounted on a support element 4' which extends into the housing 1 and bears a bimetallic tripping element 5. This thermostatic tripping element 5 is connected to a switch lever 7 via a standard metal wire 6. Switch lever 7 comprises a movable contact element, or arm, which cooperates with a fixed contact element 9. Fixed contact element 9 is electrically connected to the coil 8 of an impact-armature tripping element, or solenoid, 10 equipped with a spring-loaded rod 10*a*. The other end of the coil 8 is electrically connected to the lower screw clamp 4*b* via a stranded metal wire 11.

The switch lever 7 is mounted in the switch so as to pivot about an axial element 12. The part of the switch lever 7 which is oriented toward the front section 13 of the switch assembly has rotatably mounted on it a three-armed arresting lever 14. The bimetallic tripping element 5 acts on one arm of the arresting lever 14*a* via an adjustable set screw 5*a*. The rod 10*a* of the impact-armature tripping element 10 acts on the second arm of lever 14*b*. The third arm of the arresting lever 14*c* cooperates with a detent lever 15 which is pivotally mounted on an axial element 16 on the forward end of the switch lever 7. One end of a link piece 17 is also pivotally mounted on the detent lever 15, but on the other end and on a different axial element. The other end of the link piece 17 is pivotally connected to a hand lever 18 which itself is also pivotally mounted in the housing 1 such that the grip member 18*a* extends through an opening in the forward sidewall 13. Hand lever 18 is spring-loaded by a flat wire spring 19 which tends to bring the grip member 18*a* to its uppermost position, corresponding to the "open" state of the switch. Further, the switch lever, contact arm 7 is secured by a tension spring 20.

Figure 2:
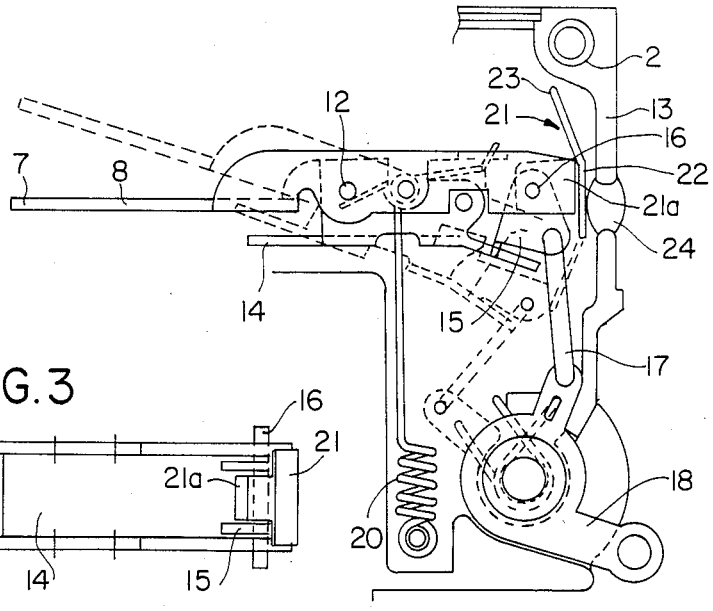
FIG. 2 is an enlarged view of part of FIG. 1.

With reference to FIG. 2, one sees an elongated slightly bent indicator strip 21 mounted on the forward end of the switch lever 7; the front side of this strip 21 is closest to the forward section 13 of the housing 1. Stip 21 is essentially flat, except for the one bend above-mentioned. Strip 21 consists of two sections 22 and 23. Section 22 faces a rectangular window 24 in the narrow forward wall of the switch 13 just above the hand lever 18*a*. Section 22 serves as an indicator which is visible through window 24 when the switch lever 7 is in is in the closed-contact position with respect to contact element 9. When these switch contacts 7 and 9 are separated, indicator section 23 has been swung behind the window 24 by the action of switch lever 7, so that the open-state of the switch may be clearly indicated to an external observer; i.e., section 22 can be designated "ON" while section 23 can be read as "OFF", or color-coding may be employed.

Figure 3:
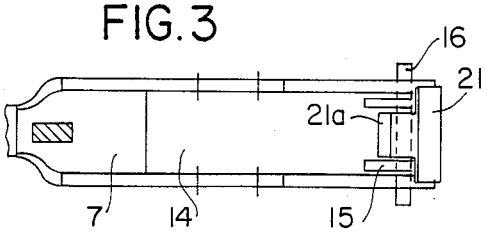
FIG. 3 is a bottom view of the switch of FIG. 1.

As evident from FIG. 3, the rear side of the strip 21 bears a block 21*a* in the region of section 22, through which block the pivotal element 16 passes thereby pivotally securing both the indicator strip 21 and the detent lever 15 on the forward end of switch lever 7. This block 21*a* is comprised of a plastic material, is pushed over pivot 16 with substantial axial friction during assembly, and is thus held fixedly in place on said pivot 16 by interference fit, i.e., strong frictional force. This contributes to ease of assembly.

I claim:

1. An automatic switch with open and closed contact positions, comprising:

a movable contact piece disposed in a housing on one end of a rotatably mounted switch arm, a solenoid adjacent said switch arm for operating said switch arm, said switch-arm bearing a three-armed locking lever;

one arm of said three-armed locking lever having a releasably lockable locking pawl, said locking pawl being rotatably mounted on the other end of said switch arm and connected to a rotatably mounted grip lever via a linking piece;

a grip portion of said grip lever extending out through an opening in a front side of said housing;

a window being disposed in said front side of said housing near said opening for said grip portion;

a strip having a first region which is disposed behind said window when said switch arm is in a first position;

said first region being disposed beside said window when said switch arm is in a second position;

said window being located near a region of said one end of said switch arm bearing said locking pawl;

said strip having said region being located on said one of said switch arm bearing said locking pawl.

2. An automatic switch according to claim 1 wherein said strip is secured in common to a pivot element of a detent lever by means of a mounting block which subtends said lever.

3. An automatic switch according to claim 1 wherein said strip is longer than said window in the direction of movement of said opposite end of said switch arm, and wherein said strip is comprised of two differently colored sections which are arranged for exclusive viewing through said window in accordance with respective ones of said first and said second positions of said switch lever.

4. An automatic switch according to claim 2 wherein said mounting block is composed of a plastic material and is mounted by interference fit to said pivot element.

* * * * *